United States Patent [19]

Usui

[11] 4,070,209

[45] Jan. 24, 1978

[54] METHOD OF PRODUCING A HIGH PRESSURE FUEL INJECTION PIPE

[75] Inventor: Masayoshi Usui, Numazu, Japan

[73] Assignee: Usui International Industry, Ltd., Japan

[21] Appl. No.: 743,081

[22] Filed: Nov. 18, 1976

[51] Int. Cl.[2] ..... C21D 9/14

[52] U.S. Cl. ..... 148/12 R; 148/12 E

[58] Field of Search ..... 72/370; 148/12 R, 12 F, 148/12 E, 12 EA

[56] References Cited

U.S. PATENT DOCUMENTS

| | | | |
|---|---|---|---|
| 2,184,624 | 12/1939 | Raab et al. | 148/12 R |
| 2,632,235 | 3/1953 | Doyle et al. | 148/12 R |
| 3,516,874 | 6/1970 | Maker et al. | 148/4 |
| 3,844,846 | 10/1974 | Friske et al. | 148/11.5 A |

*Primary Examiner*—W. Stallard

*Attorney, Agent, or Firm*—Burns, Doane, Swecker & Mathis

[57] ABSTRACT

A steel blank pipe is first subjected to the step of cutting off the hair crack layer portion including the black skin layer of the inner peripheral wall surface of the blank pipe. Thereafter, the steel blank pipe is repetitively subjected to the process of dilation or drawing of the length and the process of annealing within a non-oxidizing hearth.

5 Claims, 6 Drawing Figures

METHOD OF PRODUCING A HIGH PRESSURE FUEL INJECTION PIPE

BACKGROUND OF THE INVENTION

1. Field of the Invention

This invention relates to a method of producing a high pressure fuel injection pipe often used as a fuel supply line for a Diesel internal combustion engine, and more particularly to such a method which comprises the steps of cutting off the hair crack layer portion including the black skin layer of the inner wall surface of a steel blank pipe, and thereafter repetitively subjecting said steel blank pipe to the process of pipe dilation and the annealing process within a non-oxidizing hearth, thereby forming a finished pipe.

2. Description of the Prior Art

In the prior art method of producing such a type of injection pipe, a steel blank pipe whose inner peripheral wall surface has a black skin layer and hair crack layer portion of the order of 0.1 to 0.15 mm in thickness has immediately been repetitively subjected to the process of pipe dilation and the process of annealing within a non-oxidizing environment.

According to this method, however, numberless crack layers which have grown into a black skin layer have remained in the finished pipe of desired final diameter, so that the roughness of the inner peripheral wall surface of the finished pipe has been 8S or higher (see the photograph of FIG. 2B of the accompanying drawings) and the black skin layer has been peeled off by the internal fluid pressure and in addition, the numberless crack layers so grown have further been grown with the use of the pipe, thus resulting in deteriorated resistance to pressure of the pipe which have often led to fractures or breakage of the pipe during the use thereof.

SUMMARY OF THE INVENTION

It is an object of the present invention to prevent the hair crack layer including the black skin layer from remaining in the inner peripheral wall surface of a finished injection pipe of desired final diameter and thereby provide a smooth inner peripheral wall surface of such pipe.

It is another object of the present invention to prevent fractures or breakage which would otherwise result from the growth of the hair crack caused by the process of pipe dilation or drawing being repetitively effected, to thereby prevent the deterioration of the resistance to pressure of the pipe, thus providing a strong fuel injection pipe which has a high anti-pressure strength.

The invention will become more fully apparent from the following detailed description of an embodiment thereof taken in conjunction with the accompanying drawings.

DESCRIPTION OF THE PREFERRED EMBODIMENTS

Figure 1:
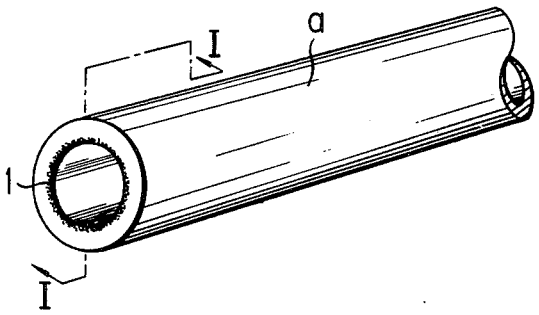
FIG. 1 is a perspective view of an injection pipe produced by the method according to the prior art.
Figure 2A:
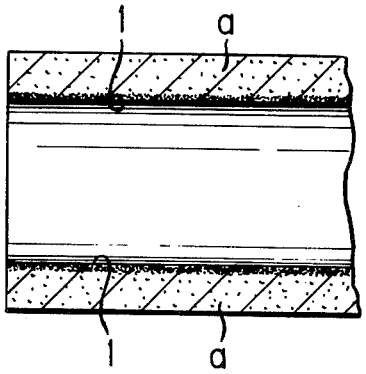
FIG. 2A is an enlarged cross-sectional view taken along line I—I of FIG. 1.
Figure 2B:
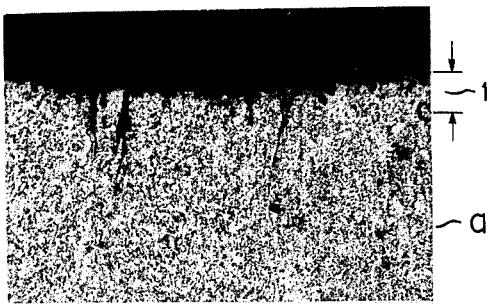
FIG. 2B is a photograph (×-200) taken of the cross-section of the injection pipe shown in FIG. 2A.
Figure 4B:
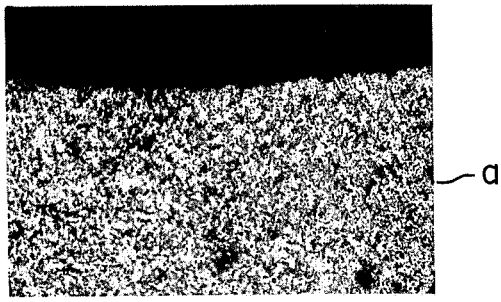
FIG. 4B is a photograph (×-200) taken of the cross-section of the injection pipe shown in FIG. 4A.

To achieve the above objects, according to the present invention, a steel blank pipe *a* is first subjected to the step of cutting off a hair crack layer portion 1 including the black skin layer of the inner peripheral wall surface of the blank pipe, and thereafter the steel blank pipe is repetitively subjected to the process of pipe dilation and the process of annealing within a non-oxidizing hearth, thereby forming a finished pipe. By doing so, it is possible to eliminate the above-noted disadvantages peculiar to the prior art method and provide a strong fuel injection pipe which is free of fracture and has a high anti-pressure strength, as shown in the photograph of FIG. 4B.

An example of the method according to the present invention will be shown below.

Blank pipe . . . material: STS 35; outer diameter: 340mm; inner diameter: 244mm; length: 2750mm; wall thickness: 4.8mm Cutting tool . . . Beisner type deep hole drilling machine Model FMF2-3000 (made by Fuji Works, Ltd.)

Cutting conditions . . . number of revolutions: 1000 r.p.m.;

feed speed: 600 mm/min.;

cutting allowance: 0.3mm

| Blank pipe before dilated | outer diameter | inner diameter | wall thickness |
|---|---|---|---|
| | 34.0mm | 25.0mm | 4.5mm |
| 1st dilation | 27.0mm | 19.4mm | 3.8mm |
| 2nd dilation | 21.0mm | 14.0mm | 3.5mm |
| 3rd dilation | 16.0mm | 9.6mm | 3.2mm |
| 4th dilation | 12.0mm | 6.2mm | 2.9mm |
| 5th dilation | 9.0mm | 4.0mm | 2.5mm |
| 6th dilation | 6.0mm | 2.0mm | 2.0mm |

Figure 3:
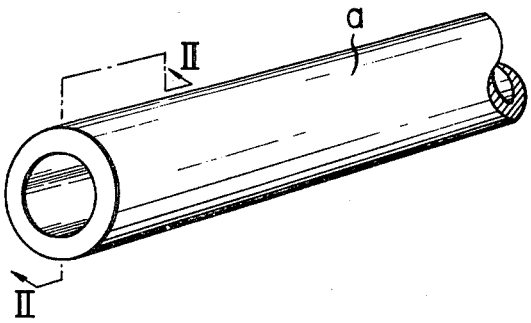
FIG. 3 is a perspective view of an injection pipe produced by the method of the present invention.
Figure 4A:
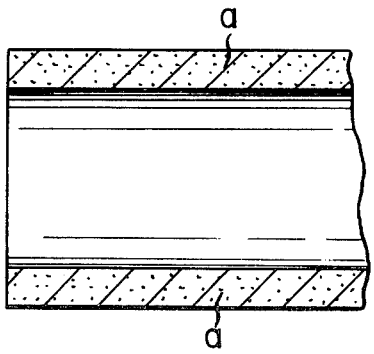
FIG. 4A is a cross-sectional view taken along line II—II of FIG. 3.

Annealing was effected before each step of pipe dilation and within a non-oxidizing hearth of nitron gas at a temperature of 900° C for 15 minutes. The state of the inner peripheral wall surface was such that the surface roughness was 3S or less and hair crack was substantially inappreciable (see the photograph of FIG. 3).

Throughout the drawings, reference character *a* designates the steel blank pipe and numeral 1 denotes the hair crack layer portion including the black skin layer.

What we claim is:

1. A method of producing a high pressure fuel injection pipe comprising the steps of cutting off the hair crack layer portion including the black skin layer of the inner peripheral wall surface of a steel blank pipe, and thereafter repetitively subjecting said steel blank pipe to the process of said radially inner wall having a hair crack layer portion and a black skin layer dilation of the length and the process of annealing within a non-oxidizing hearth, thereby forming a finished pipe.

2. a method of reducing the hairline cracks in the radially inner wall of a steel pipe comprising the steps of:

a. providing a steel pipe having an inner diameter, an outer diameter and a wall thickness each dimensioned greater than desired in a finished pipe;

b. removing the hair crack layer portion including the black skin layer of the radially inner wall of the pipe;

c. drawing the pipe to effect a reduction in the inner diameter, outer diameter and wall thickness;

d. annealing the pipe in a non-oxidizing environment; and, e. repeating steps (c) and (d) above until the desired dimensions of the finished pipe are obtained.

3. A method of claim 2 wherein said dimensional reduction is accomplished in not less than four steps.

4. A method of claim 3 wherein said annealing is accomplished in a non-oxidizing hearth of nitrogen gas.

5. A method of claim 2 wherein said annealing is accomplished in a non-oxidizing hearth of nitrogen gas.

* * * * *